US008182381B2

(12) United States Patent
Gunton

(10) Patent No.: US 8,182,381 B2
(45) Date of Patent: May 22, 2012

(54) DRIVE ARRANGEMENT

(76) Inventor: Bruce Stanley Gunton, Yoxall (GB)

( * ) Notice: Subject to any disclaimer, the term of this patent is extended or adjusted under 35 U.S.C. 154(b) by 188 days.

(21) Appl. No.: 12/299,448

(22) PCT Filed: May 3, 2007

(86) PCT No.: PCT/GB2007/001637

§ 371 (c)(1),
(2), (4) Date: Jan. 26, 2009

(87) PCT Pub. No.: WO2007/129059

PCT Pub. Date: Nov. 15, 2007

(65) Prior Publication Data

US 2009/0205790 A1 Aug. 20, 2009

(30) Foreign Application Priority Data

May 6, 2006 (GB) ..... 0608974.2

(51) Int. Cl.
*F16H 7/18* (2006.01)
*A47H 1/00* (2006.01)
*E06B 9/08* (2006.01)

(52) U.S. Cl. ..... 474/100; 160/310; 160/321

(58) Field of Classification Search ..... 160/133, 160/188, 238, 310, 311, 321; 74/625; 474/100, 474/110, 111, 140
See application file for complete search history.

(56) References Cited

U.S. PATENT DOCUMENTS

| | | | | |
|---|---|---|---|---|
| 2,670,065 | A * | 2/1954 | Stevens, Jr. | 192/18 R |
| 2,676,294 | A * | 4/1954 | Wilcox | 318/266 |
| 2,742,280 | A * | 4/1956 | Wilcox | 160/189 |
| 4,452,292 | A | 6/1984 | Leivenzon et al. | |
| 6,155,324 | A * | 12/2000 | Elliott et al. | 160/1 |
| 6,188,198 | B1 * | 2/2001 | Gunton | 320/117 |
| 7,437,971 | B2 * | 10/2008 | Gunton | 74/625 |
| 8,033,374 | B2 * | 10/2011 | Gunton | 192/224 |
| 2004/0144201 | A1 * | 7/2004 | Gunton | 74/625 |
| 2008/0127558 | A1 | 6/2008 | Gunton | |
| 2010/0105507 | A1 * | 4/2010 | Gunton | 474/133 |

FOREIGN PATENT DOCUMENTS

| | | |
|---|---|---|
| AU | 519424 | 12/1981 |
| AU | 560693 | 4/1987 |
| GB | 2189284 | 10/1987 |
| WO | 9723703 | 7/1997 |
| WO | 2005045170 | 5/2005 |
| WO | WO 2005090730 A1 * | 9/2005 |

* cited by examiner

*Primary Examiner* — Blair M Johnson
*Assistant Examiner* — Jaime F Cardenas-Garcia
(74) *Attorney, Agent, or Firm* — Chernoff, Vilhauer, McClung & Stenzel

(57) ABSTRACT

A wheel turns about a fixed shaft to reel in or pay out an aperture closure member. A motor provides drive to the wheel through a belt. The motor is mounted on a slider plate which can slide relative to a fixed plate, which is secured to the shaft. As the slider plate slides away from the shaft, the belt comes into tension allowing the motor to drive the wheel.

9 Claims, 6 Drawing Sheets

DRIVE ARRANGEMENT

This is a national stage application filed under 35 USC 371 based on International Application No. PCT/GB2007/001637 filed May 3, 2007, and claims priority under 35 USC 119 of United Kingdom Patent Application No. 0608974.2 filed May 6, 2006.

The present invention relates to drive arrangements.

Drive arrangements are used for aperture closure arrangements such as domestic garage doors, factory and warehouse doors and the like. Types of aperture closure member include flexible members made of reinforced fabric or sheet metal, or sectional closures made of separate sections which are articulated to each other. These closure members can be moved along curved tracks or rolled around rollers or drums in order to open and close the corresponding aperture. Typically, the closure member moves vertically, either rolling on and off a roll above the aperture, or onto and off a track extending inwardly from the top of the aperture.

One example of an aperture closure arrangement is illustrated schematically and simply in FIG. 1. A roller 1 carries a flexible aperture closure member 2 and is mounted by means of a shaft 3 to a support 4 to extend across the top of the aperture closed by the member 2. The shaft 3 is fixed in position and fixed against rotation. The roller 1 turns on the shaft 3 by means of a bearing or simple journal mounting (not shown). This rotation pays out or reels in the member 2, thereby opening or closing the aperture.

Embodiments of the present invention provide a drive arrangement for an aperture closure arrangement which has a substantially non-rotating support member and a rotatable member supported for rotation relative to the support member to pay out or reel in an aperture closure member, the drive arrangement having:

a base part and securing means for securing the base part to the support member to prevent rotation relative to the support member;

a drive mounted on the base part to provide drive for turning the rotatable member; and a disengageable clutch arrangement through which drive for driving the rotatable member is transmitted, in use, from the drive arrangement, when the clutch arrangement is engaged.

The securing means may be operable for securing the base part on a non-rotating support shaft of the aperture closure arrangement, the support shaft, in use, carrying the rotatable member for rotation about the shaft.

The drive arrangement may include an intermediate rotatable member driven through the clutch arrangement and having coupling means for coupling to drive the rotatable member of the aperture closure arrangement. The intermediate member may have an associated bearing for mounting the intermediate member for rotation relative to the non-rotating support member. The associated bearing may mount the intermediate member on the support member or on the base part.

Drive may be transmitted from the clutch arrangement by an endless loop member driven by a drive wheel. The clutch arrangement may be operable to move the drive wheel to engage and disengage the endless loop member. The endless loop member may be a chain or belt. The endless loop member may connect to the drive wheel and the intermediate member, when the clutch arrangement is engaged.

The drive wheel may be slidably mounted on the base part. The drive wheel may be rotatably mounted on a slide plate supported by the base part and slidable relative thereto. The drive may be secured to the slide plate to be slidable, with the drive wheel, relative to the base part.

The clutch arrangement may include an arrangement for controlling the position of the slide plate relative to the base part. The control arrangement may releasably urge the slide plate, relative to the base part, in a direction which causes the drive wheel to engage the endless loop member. The control arrangement may further comprise a user control for activating and releasing the control arrangement. The user control may be at a location remote from the base part.

The arrangement may include a second slider member movable relative to the base part, into and out of driving engagement with the rotatable member. The second slider member and the rotatable member may carry respective teeth which mesh when in driving engagement. The second slider member may include manually operable drive means for manually driving the rotatable member when the second slider member is in driving engagement with the rotatable member. The manually operable drive means may comprise a wheel operable to turn by means of an elongate closed loop member.

The arrangement may be controlled by a Bowden cable having an inner cable and sheath which apply force between the slide plate and the second slider member. Spring means may be provided to urge the second slider member into driving engagement with the rotatable member, when the Bowden cable is released.

Examples of the present invention will now be described in more detail, by way of example only, and with reference to the accompanying drawings, in which.

Figure 1:
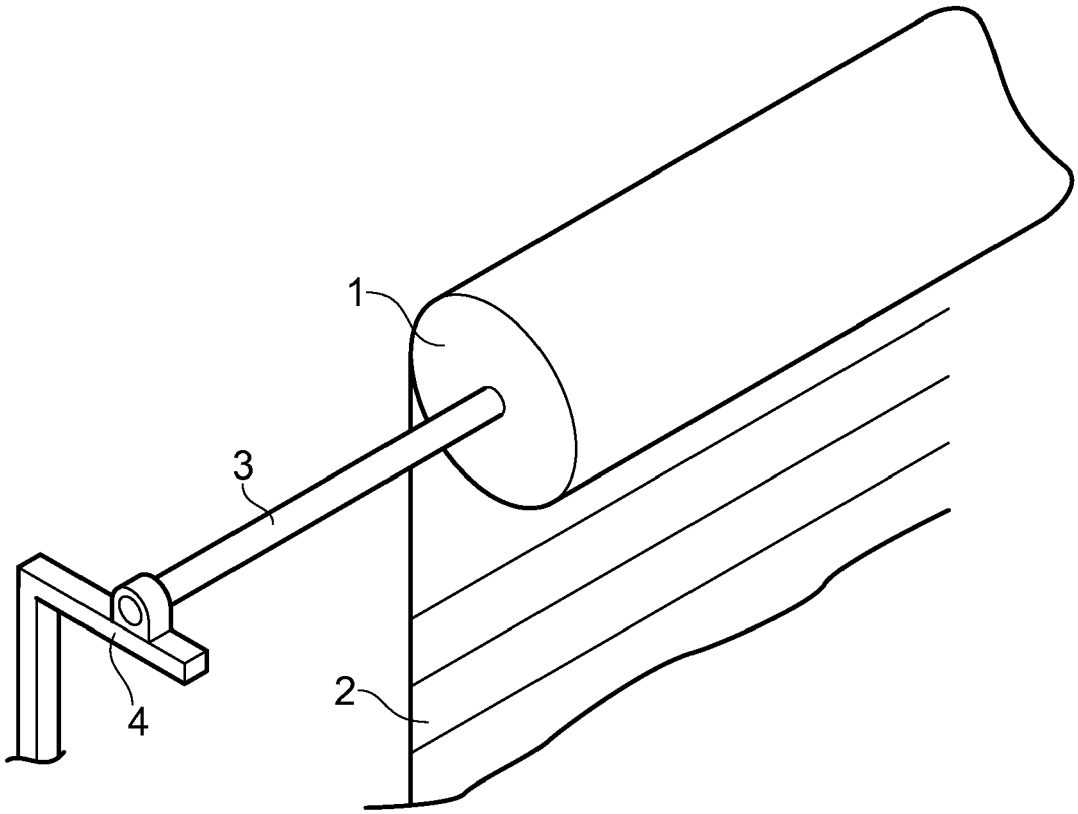
Fig. 1 (Prior Art)
FIG. 1 is a simple schematic diagram of a known aperture closure arrangement.
Figure 2:
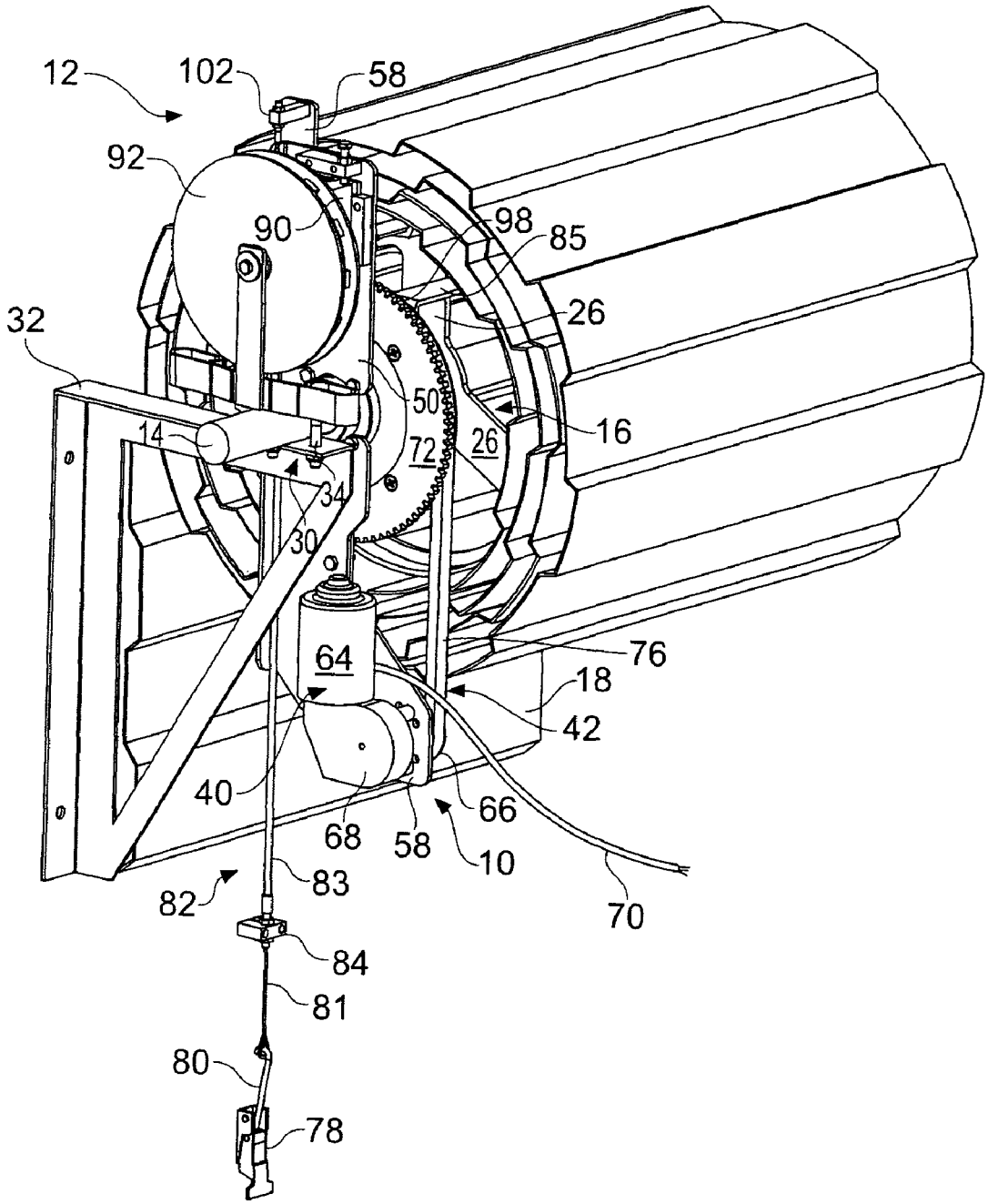
FIG. 2 is a partial rear perspective view of an aperture closure arrangement having a drive arrangement according to one embodiment of the invention.
Figure 3:
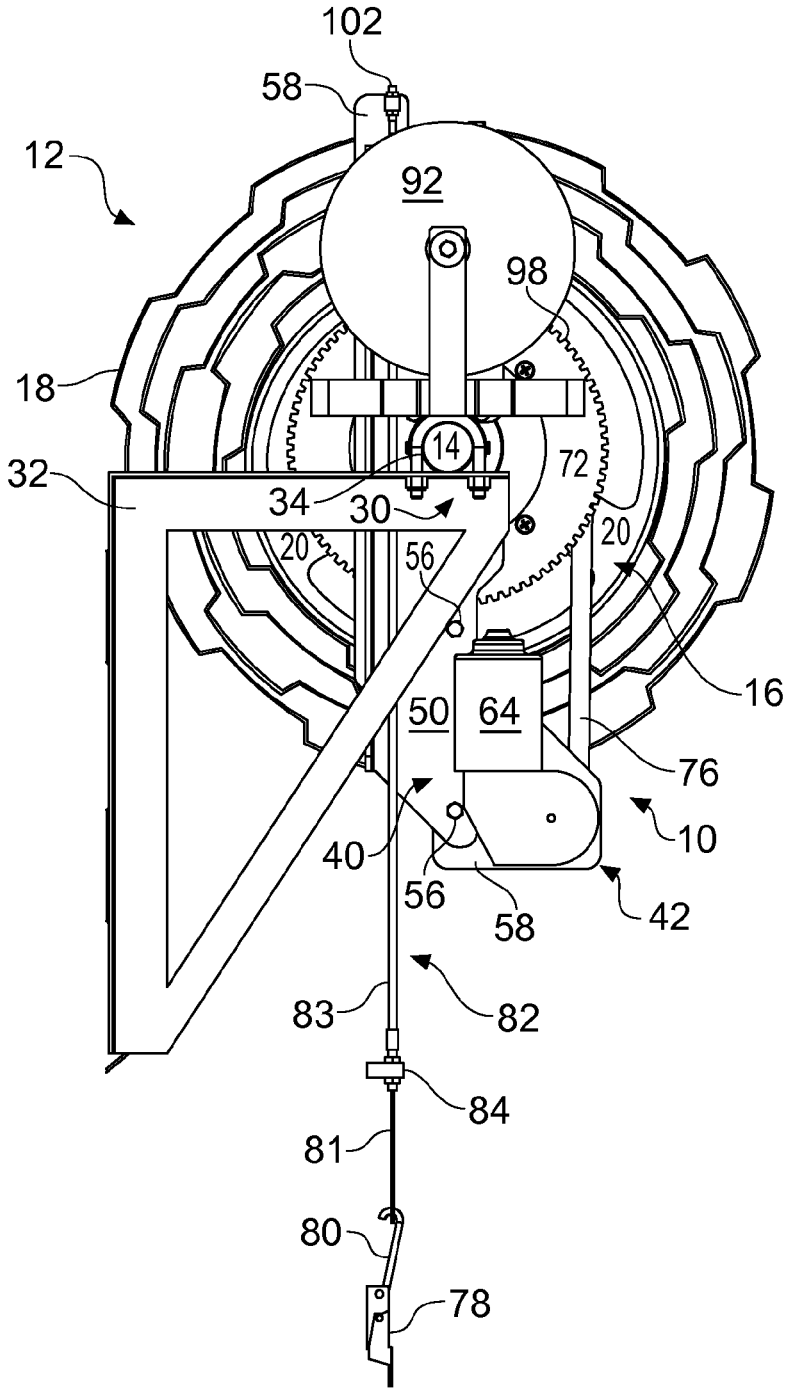
FIG. 3 is an end elevation corresponding with FIG. 2.

FIGS. 2 to 6 illustrate a drive arrangement 10 for an aperture closure arrangement 12. The arrangement 12 has a substantially non-rotating support member 14 in the form of a shaft, and a rotatable member 16 supported for rotation about the shaft 14. This rotation pays out or reels in an aperture closure member 18 in the form of a flexible or slatted door.

In this example, the member 16 is a wheel. The rim of the wheel 16 engages the member 18 which will roll on or off the wheel 16 as it rotates. Spokes 26 connect the wheel rim to a central portion 28 which receives the shaft 14. The materials of the shaft 14 and the central portion 28 may be chosen to provide low friction between them, or a bearing may be provided, thus allowing the wheel 16 to rotate around the shaft 14.

In an alternative, the member 18 may roll on and off a cylindrical member, the wheel being inside the cylindrical member, to turn the cylindrical member with the wheel 16.

The shaft 14 is secured at 30 to a supporting bracket 32. A U-clamp 34 holds the shaft 14 fixed in position relative to the bracket 32, and further holds the shaft 14 against rotation. Accordingly, the weight of the members 16, 18 is borne by the bracket 32, through the shaft 14, while allowing the member 16 to turn by turning the wheel 16 about the shaft 14, thus allowing the member 18 to be paid out or reeled in.

Having described the aperture closure arrangement 12, the drive arrangement 10 can now be described in more detail.

The drive arrangement 10 has a base part 36, securing means at 38 for securing the base part to the shaft 14, a drive indicated generally at 40 to provide drive for turning the member 16, and a disengageable clutch arrangement indicated generally at 42.

In more detail, the base part 36 has a sleeve portion (see particularly FIG. 5) and a circumferential flange 46 at one end. The sleeve 44 is located around the shaft 14. Radial screws 38 (FIG. 4) secure the base part 36 to the shaft 14, preventing the base part 36 from moving along the shaft 14 or rotating about it. In the illustrated example, the base part 36 is circular, and sits alongside the bracket 32. In an alternative example, the base part 36 may sit on the bracket 32, between the shaft 14 and the bracket 32, being held in position by the clamping action of the U-clamp 34. This makes the arrangement more compact, by reducing the required axial extent of the arrangement. In this alternative, the base part 36 may have a flat against the bracket 32.

The base part 36 also carries a fixed plate 50 which has an aperture at 52 to receive the sleeve portion 44. Fixing screws 54 (FIG. 2) fix the plate 50 to the flange 46. Thus, the fixed plate 50 cannot move along or around the shaft 14.

Away from the shaft 14, the fixed plate 50 carries two posts 56. A sliding plate 58 has two parallel slots 60 which receive the posts 56. The sliding plate 58 is retained on the posts 56 by oversize heads 62 of the posts 56. This provides restricted freedom for the sliding plate 58 to move relative to the fixed plate 50 and the shaft 14, by moving transverse to the shaft 14 axis.

The drive 40 is carried by the sliding plate 58 and includes an electric motor 64 and a drive wheel 66 connected by a gearbox 68 to be driven by the motor 64. Power to the motor 64 is provided by wires 70, illustrated schematically in FIG. 2 alone. In some installations, greater compactness may be desirable, for example by mounting the gearbox 68 and motor 64 on the other face of the sliding plate 58.

A driven wheel 72 is mounted on the sleeve 44 by means of bearings 74, so that the driven wheel 72 can rotate relative to the shaft 14. Alternatively, the driven wheel 72 may be mounted directly on the shaft 14, such as by means of a bearing, but this would require the base part 36 and the driven wheel 72 to be mounted on the shaft 14 in separate operations. The arrangement illustrated in the drawings allows the drive arrangement 10 to be installed on the shaft 14 by the single installation operation of introducing the base part 36 around the shaft 14, and securing the base part 36 to the shaft 14, by means of the securing screws 38.

An endless loop member 76 extends around the drive wheel 66 and driven wheel 72. In this example, the wheels 66, 72 have circumferential recesses of V-section and the member 76 has a V-section. This improves grip between the loop member 76 and the wheels 66, 72, in use. The loop member 76 may be a rubber or other flexible belt, or may be a chain, in which case the wheels 66, 72 may be provided with circumferential teeth.

An over-center catch arrangement 78 is provided at a convenient location, having an arm 80 connected to the inner cable 81 of a Bowden cable 82, the sheath 83 of which is fixed at 84. In the locked position illustrated in FIG. 2, the catch arrangement 78 causes the arm 80 to pull the inner cable 81. In a manner to be described below, this moves the sliding plate 58 to pull the motor 64 and drive wheel 66 away from the driven wheel 72, resulting in tension in the belt 76, which results in the wheels 66, 72 being engaged by the belt 76, so that the drive wheel 66 can drive the driven wheel 72 by means of the belt 76.

Alternatively, the catch arrangement 78 can be released to free the sliding plate 58. This allows the drive wheel 66 to move toward the shaft 14, allowing the belt 76 to be released from engaging the wheels 66, 72, particularly if the means of engagement is friction arising from tension within the belt 76.

In an alternative, the catch arrangement 78 may act directly between the sliding plate 58 and the fixed plate 50.

In this example, the driven wheel 72 has two arms 85 which extend parallel to the shaft 14 to sit either side of a spoke 26. This prevents the wheel 16 turning around the shaft 14, except with the driven wheel 72. In an alternative arrangement, the driven wheel may carry a single bar formed in a W shape, the apexes at the base of the W shape being received by the wheel 16 to connect the wheels 16, 72 in the manner described. A further alternative may use a tongue positioned on the driven wheel 72 to locate in the "V" between adjacent spokes 26. The wheel 16 may alternatively be a pressing, plate or other generally continuous body having an aperture for receiving an arm or tongue of the wheel 72. Many other arrangements for coupling the wheels 16, 72 can be envisaged.

In use, when the member 18 is to be paid out or reeled in, the catch arrangement 76 is engaged in order to engage the clutch arrangement by pulling the drive wheel 66 away from the shaft 14, to engage the belt 76 with the wheels 66, 72. This allows the motor 64 to drive the wheel 72 through the gearbox 68, the drive wheel 66 and the belt 76. Accordingly, when the motor 64 is operated, the driven wheel 72 turns around the shaft 14, pulling the wheel 16 with it, by means of the arms 85, paying out or reeling in the member 18, according to the sense of rotation.

When the motor 64 operates, the torque reaction to rotation of the wheel 16 is borne through the fixed plate 50 by the shaft 14, by virtue of the securing screws 38, which prevent the plate 50 turning around the shaft 14.

During normal use, the catch arrangement 78 will remain engaged to allow the member 18 to be opened or closed in the manner just described, by appropriate operation of the motor 64. The permanent engagement of the clutch arrangement between the motor 64 and the driven wheel 72 results in the member 18 being locked at its current position, except when the motor 64 is operated.

In fault conditions, or during maintenance or the like, the catch arrangement 78 can be released to disengage the clutch arrangement between the motor 64 and the driven wheel 72. This unlocks the member 18, allowing the member 18 to be moved manually. Chains or other mechanisms may be provided to allow the member 16 to be turned manually, to open or close the member 18, when the catch arrangement 78 is released. One example will now be described.

Figure 4:
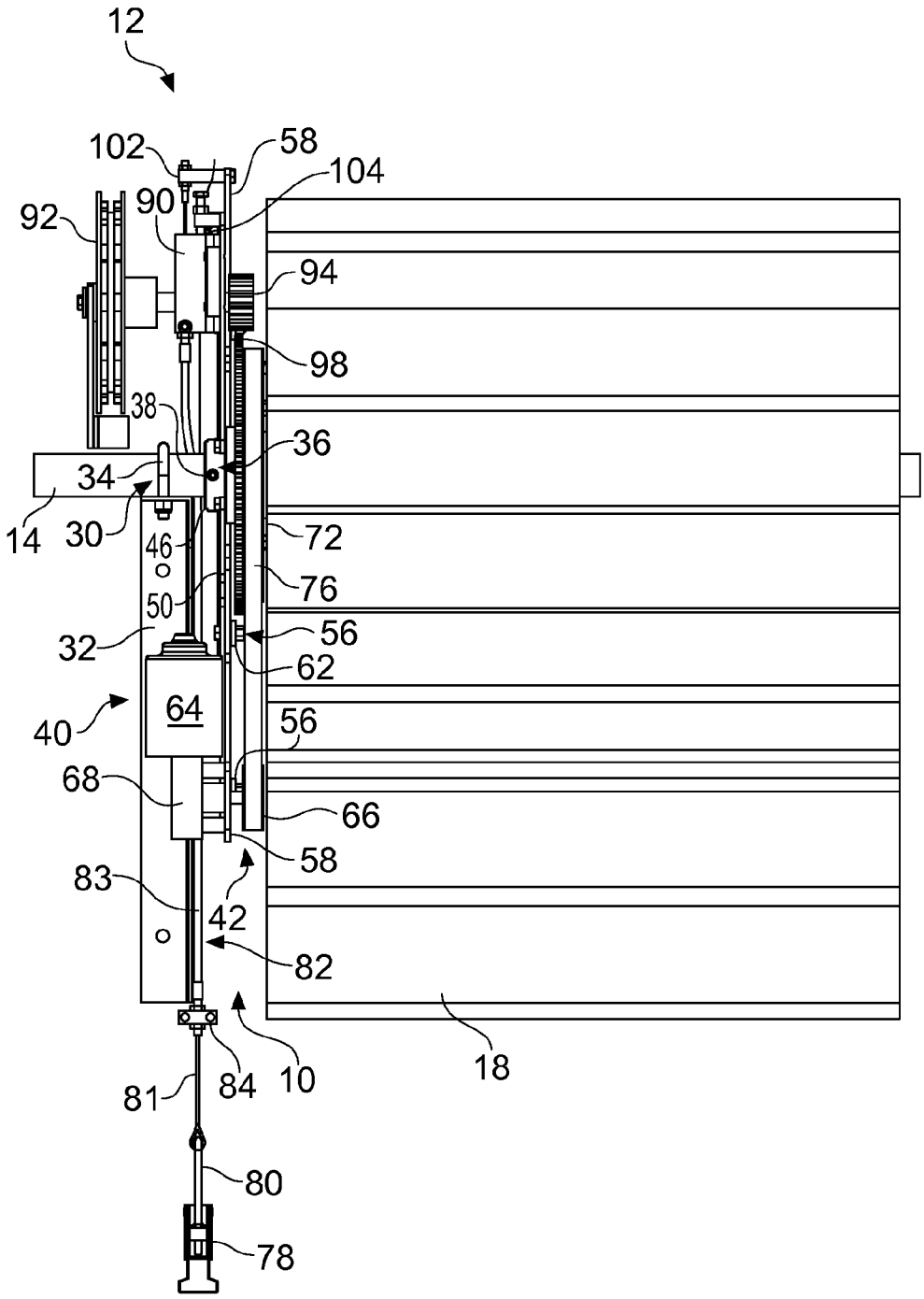
FIG. 4 is a partial rear elevation corresponding with FIG. 2.
Figure 5:
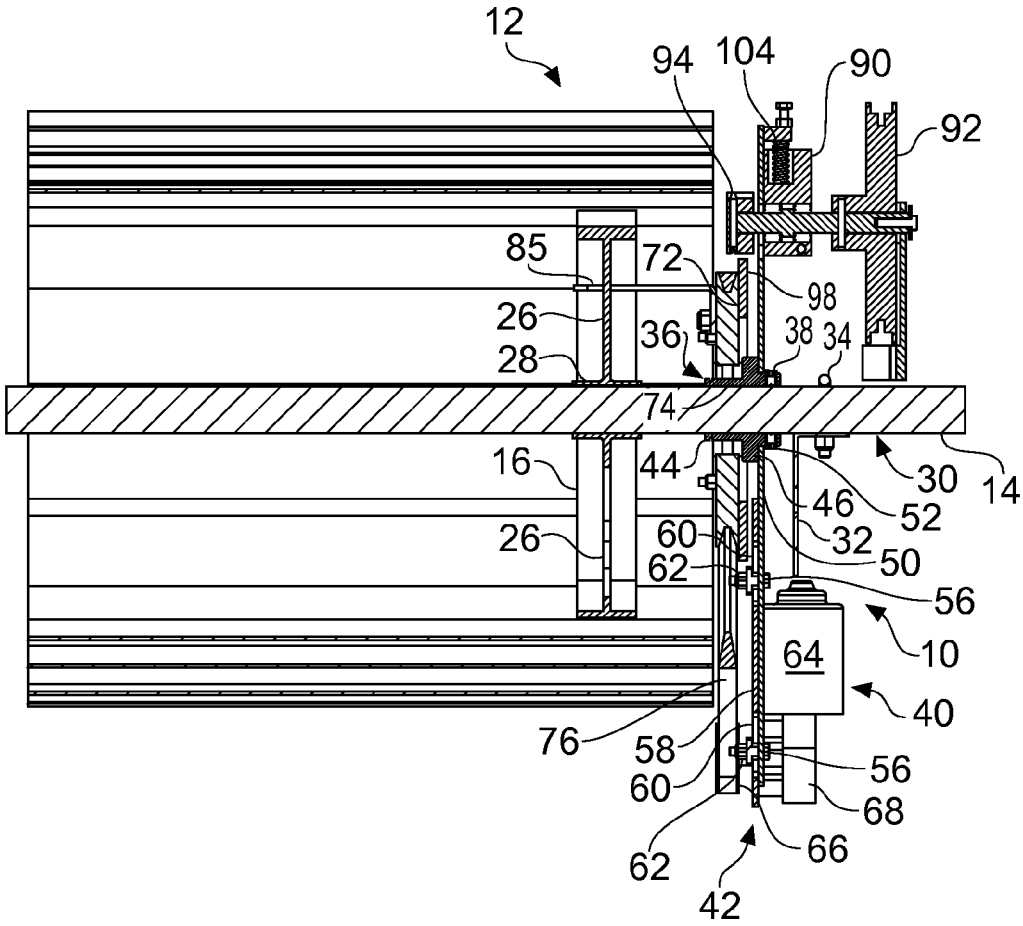
FIG. 5 is a partial section at the line 5-5 of a vertical plane passing through the axis of the fixed shaft of FIG. 2.
Figure 6:
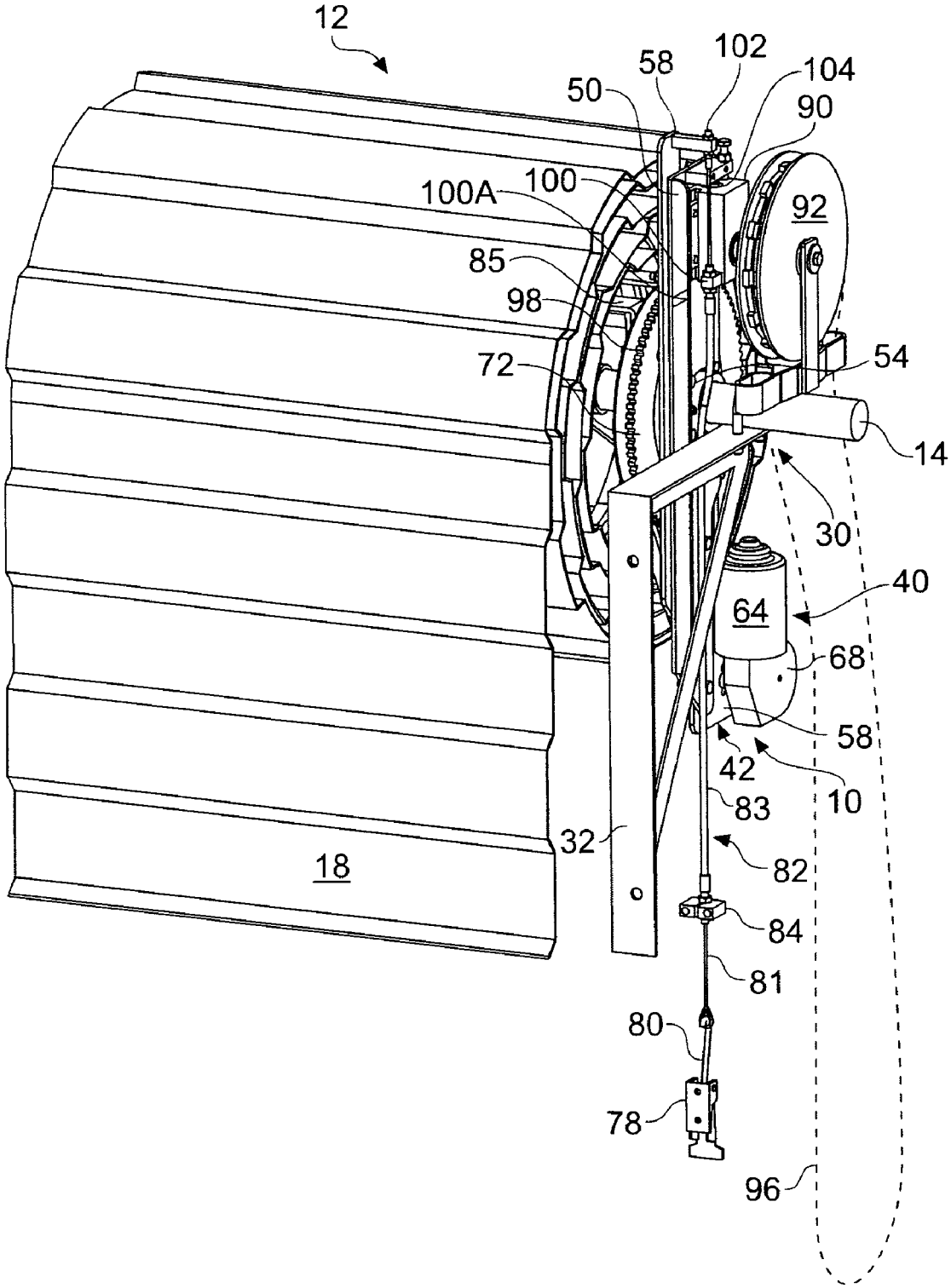
FIG. 6 is a partial front perspective view of the arrangement.

The fixed plate 50 and sliding plate 58 extend above the shaft 14, as can be seen particularly from FIG. 6. A second slider 90 is slideably mounted on the fixed plate 50, above the shaft 14 and independently of the sliding plate 58. The second slider carries a chain wheel 92 concentric with a toothed wheel 94 (FIG. 4). The wheels 92, 94 are free to rotate on the second slider 90 and can move toward or away from the shaft 14, as the second slider 90 slides on the fixed plate 50. The wheels 92, 94 are coupled to turn together.

The chain wheel 92 carries an elongate, closed loop member, such as an endless chain 96, illustrated schematically by broken lines in FIG. 6. The chain 96 preferably hangs down from the wheel 92 to a position near the bottom of the aperture, at which the chain can conveniently be accessed by a user to turn the wheels 92, 94.

The driven wheel 72 has a circumferential ring of teeth 98. The wheel 94 and the teeth 98 are aligned so that, as the slider 90 slides toward or away from the shaft 14, the toothed wheel 94 moves into or out of mesh with the teeth 98. Thus, using the chain 96 to turn the wheel 92 allows the driven wheel 72 to be turned manually, when the toothed wheel 94 is in mesh with the teeth 98. When the wheel 94 and teeth 98 are in mesh, the clutch 42 will be disengaged by virtue of the action of the Bowden cable 82, as can now be described.

Within the arrangement 10, the sheath 83 is fixed at 100 to the second slider 90. The inner cable 81 is fixed at 102 to the sliding plate 58. A spring at 104 acts between the second slider 90 and the fixed plate 50.

When the inner cable 81 is pulled down, the free length of the inner cable 81 between the positions 100, 102 shortens. This creates a force to pull the points 100, 102 toward each other. Upward movement of the second slider 90 is counted by the action of the spring 104. Downward movement of the sliding plate 58 is resisted by tension increasing in the belt 76. Consequently, both the sliding plate 58 and the second slider 90 will tend to move. Appropriate choice of strength for the spring 104 allows the catch arrangement 78 to move the second slider 90 away from the shaft 14, thereby disengaging the wheel 94 from the teeth 98, and to slide the plate 58 to move the drive wheel 66 away from the driven wheel 72, thereby engaging the clutch arrangement 42. The catch arrangement 78 is normally locked in this condition, so that the chain 96 is disabled from turning the driven wheel 72, and with the motor 64 able to drive the wheel 16, in the manner which has been described.

Disengaging the catch arrangement 78 releases the inner cable 81. The action of the spring 104 then causes the sliding plate 58 to move the drive wheel 66 toward the driven wheel 72, thus disengaging the clutch arrangement 42, and simultaneously moves the second slider 90 toward the shaft 14, thus engaging the toothed wheel 94 with the teeth 98, allowing the chain 96 to be used for manual control of the member 18.

The catch arrangement 78 and Bowden cable 82 may be replaced with an electrical or electromechanical arrangement, controlled by appropriate electrical signals from a remote control panel.

In another example, which does not include a chain drive, the Bowden cable sheath 83 may be secured at 100A to the fixed plate 50, so that the Bowden cable 82 acts between the fixed plate 50 and the sliding plate 58, allowing the drive wheel 66 to be forced away from the driven wheel 72 to engage the clutch 42, or to be released to disengage the clutch. In this example, the second slider 90, the wheels 92, 94, the chain 96, the teeth 98 and the spring 104 are not required.

The drive arrangement 10 provides a self-contained arrangement which can be installed for an aperture closure arrangement 12 in a simple manner, by installing the base part 36 on the shaft 14; and connecting the driven wheel 72 to the rotatable member 16. In a further example, the driven wheel 72 may be omitted, with the loop member 76 being passed around an appropriate component of the arrangement 12, such as the wheel 16, to drive the arrangement 12 directly from the drive wheel 66.

Many variations and modifications may be made to the examples described above, without departing from the scope of the invention. In particular, many different component shapes, sizes and relative sizes could be chosen.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A drive arrangement for an aperture closure arrangement having a support member which is non-rotating, in use, and a rotatable member supported for rotation relative to the support member to pay out or reel in an aperture closure member, the drive arrangement having:

a base part and securing means for securing the base part to the support member to prevent rotation relative to the support member;

a drive mounted on the base part to provide drive for turning the rotatable member; and a disengageable clutch arrangement through which drive for driving the rotatable member is transmitted, in use, from the drive arrangement, when the clutch arrangement is engaged;

and wherein the drive arrangement includes an intermediate rotatable member driven through the clutch arrangement and having coupling means for coupling to drive the rotatable member of the aperture closure arrangement, and wherein drive is transmitted from the clutch arrangement by an endless loop member driven by a drive wheel, and the clutch arrangement is operable to move the drive wheel to engage and disengage the endless loop member;

and wherein the drive wheel is rotatably mounted on a slide plate supported by the base part and slidable up and down relative thereto;

and wherein the drive is secured to the slide plate to be slidable up and down, with the drive wheel, relative to the base part;

and wherein the clutch arrangement includes an arrangement for controlling the position of the slide plate relative to the base part;

and further including a second slider member movable up and down relative to the base part, into and out of driving engagement with the intermediate rotatable member;

and wherein the second slider member and the intermediate rotatable member carry respective teeth which mesh when in driving engagement;

and wherein the second slider member includes manually operable drive means for manually driving the intermediate rotatable member when the second slider member is in driving engagement with the intermediate rotatable member;

and wherein the manually operable drive means comprises a wheel operable to turn by means of an elongate closed loop member;

and wherein the arrangement is controllable by a Bowden cable having an inner cable and sheath which apply force between the slide plate and the second slider member to pull the second slider member upward and to pull the slide plate downward;

and wherein spring means are provided to urge the second slider member into driving engagement with the intermediate rotatable member, when the Bowden cable is released.

2. An arrangement according to claim 1, wherein the support member is a support shaft of the aperture closure arrangement, the support shaft, in use, carrying the rotatable member for rotation about the shaft.

3. An arrangement according to claim 1, wherein the intermediate member has an associated bearing for mounting the intermediate member for rotation relative to the non-rotating support member.

4. An arrangement according to claim 3, wherein the associated bearing mounts the intermediate member on the support member or on the base part.

5. An arrangement according to claim 4, wherein the endless loop member is a chain or belt.

6. An arrangement according to claim 4, wherein the endless loop member connects to the drive wheel and the intermediate member, when the clutch arrangement is engaged.

7. An arrangement according to claim 1, wherein the control arrangement is operable to releasably urge the slide plate, relative to the base part, in a direction which causes the drive wheel to engage the endless loop member.

8. An arrangement according to claim 1, wherein the control arrangement further comprises a user control for activating and releasing the control arrangement.

9. An arrangement according to claim 8, wherein the user control is at a location remote from the base part.

* * * * *